US006502516B1

(12) United States Patent
Kinchin

(10) Patent No.: US 6,502,516 B1
(45) Date of Patent: Jan. 7, 2003

(54) SABOT SHOTGUN SLUG ASSEMBLY

(76) Inventor: Anthony E. Kinchin, 12 Slaney Road, Walsall West Midlands, WS2 9AF (GB)

( * ) Notice: Subject to any disclaimer, the term of this patent is extended or adjusted under 35 U.S.C. 154(b) by 0 days.

(21) Appl. No.: 09/748,413

(22) Filed: Dec. 26, 2000

Related U.S. Application Data

(60) Provisional application No. 60/176,661, filed on Jan. 18, 2000.

(51) Int. Cl.[7] ..... F42B 7/10; F42B 12/34

(52) U.S. Cl. ..... 102/517; 102/439; 102/448; 102/522; 244/3.23

(58) Field of Search ..... 102/439, 448–453, 102/501, 517, 518, 520–523, 532; 244/3.23

(56) References Cited

U.S. PATENT DOCUMENTS

| | | | | | |
|---|---|---|---|---|---|
| 4,043,267 | A | * | 8/1977 | Hayashi | 102/439 |
| 4,471,699 | A | | 9/1984 | Turco et al. | 102/501 |
| 4,587,905 | A | | 5/1986 | Maki | 102/430 |
| 5,086,703 | A | * | 2/1992 | Klein | 102/439 |
| 5,415,102 | A | | 5/1995 | White et al. | 102/522 |
| 5,479,801 | A | | 1/1996 | Keller | 70/373 |
| 5,479,861 | A | | 1/1996 | Kinchin | 102/439 |
| 6,067,909 | A | | 5/2000 | Knoster, Jr. | 102/517 |
| 6,105,506 | A | * | 8/2000 | Gangale | 102/439 |
| 6,186,071 | B1 | * | 2/2001 | Fry | 102/518 |

FOREIGN PATENT DOCUMENTS

| | | | | |
|---|---|---|---|---|
| DE | 2903286 | * | 8/1980 | 102/439 |

* cited by examiner

*Primary Examiner*—Harold J. Tudor
(74) *Attorney, Agent, or Firm*—Hoffman & Baron, LLP

(57) ABSTRACT

A projectile in the form of a sabot shotgun slug assembly includes a cylindrical slug, a cylindrical sabot positioned about the slug and a pressure wad co-acting with the slug and the sabot. The cylindrical slug defines a central bore extending partially therethrough. The slug is preferably made of a deformable metal. The sabot defines a plurality of longitudinally extending internal grooves. The pressure wad has two ends, with a gas seal located at a first end and a post located at a second end. The pressure wad further includes shock-absorbing members formed between the gas seal and the post. The post is positioned within the central bore defined by the slug. In operation, after the sabot shotgun slug assembly is fired, the slug deforms and expands outward to fill the plurality of grooves defined in the sabot which mechanically locks the slug and sabot together to stop any slipping movement of the slug when torque is transferred to the slug through the sabot due to the twist of the rifling and, simultaneously, expands inward to engage the post such that the slug, the sabot and the pressure wad remain connected together while travelling downrange toward a target.

17 Claims, 2 Drawing Sheets

SABOT SHOTGUN SLUG ASSEMBLY

This application claims priority to U.S. provisional patent application No. 60/176,661, filed Jan. 18, 2000 entitled SABOT SHOTGUN SLUG.

FIELD OF THE INVENTION

The present invention relates to a projectile in the form of a sabot shotgun slug assembly and, more particularly, to a sabot which supports a slug in non-rotative engagement therewith and which remains together downrange until target impact.

BACKGROUND OF THE INVENTION

A sabot for use in positioning a bullet or projectile in a gun barrel is well known. Essentially, a sabot is a plastic sleeve that holds the projectile during firing. A typical prior art sabot includes a cylindrical body having a receiving chamber accessible at one end and a base at the other end.

It is known to use a sabot for positioning the bullet within the barrel of a rifle, muzzleloader or shotgun. Sabots may be used with both conical-shaped bullets as well as traditional lead ball bullets. When used with a firearm with a rifled barrel, the sabot is used to impart rotation to the projectile as it travels down the gun barrel after firing. In particular, the sabot is typically formed to have a diameter the same as the grooved diameter of the rifled barrel so that the sabot is pressed into the rifling after firing. As is well known, the principal behind rifling in a gun barrel is to produce a spin on the projectile about its longitudinal axis as the projectile travels through the gun barrel. The spin produces a gyroscopic effect on the projectile giving the projectile greater stability and accuracy. Sabots are also used in smoothbore gun barrels for increasing the stability of the projectile during firing.

In general, sabots are formed in two-piece sections or as multi-fingered sections that are configured to surround the exterior of the projectile. A typical two-piece sabot is disclosed in U.S. Pat. No. 5,479,801 to Kinchin. In this reference, a two-piece sabot surrounds a slug that is non-rotating and connected to the slug so that the rotary motion, which is imparted to the sabot by contact between its external surface and the rifling in a gun barrel, is transferred directly to the slug. Upon exiting the gun barrel, the two-piece sabot splits apart and falls away from the slug. Hence, the sabot does not accompany the slug downrange as it approaches its target.

As stated, sabots also are provided in a multi-fingered configuration. A typical prior art multi-fingered sabot is disclosed by U.S. Pat. No. 5,415,102 to White et al. The sabot disclosed therein has a plurality of petals or leaves that are configured to extend over a bullet. Upon discharge from a gun barrel, the petals or leaves open up to release the bullet to travel downrange toward its target.

The difficulty with two-piece and multi-fingered sabots is that they tend to open up unevenly when under pressure in the gun barrel and upon exit from the gun barrel. This causes the bullet or projectile to become out of line with the central axis of the gun barrel, thus making the projectile inaccurate.

The problem with a one piece collet cup sabot is that when it is under pressure the pressure will only expand the top of the cup which is open, the base, being solid, cannot expand fully into the rifling or the bore. The one piece tube type sabot, which is open at both ends will expand uniformly and will engage the rifling or the bore of the barrel along its full length.

SUMMARY OF THE INVENTION

It is an object of the present invention to provide a projectile in the form of a sabot shotgun slug that has increased accuracy.

A sabot shotgun slug assembly includes a hollow cylindrical sabot, a pressure wad positioned at one end of the sabot for facilitating firing. A deformably expandable slug is insertably accommodated in the cylindrical sabot at the other end thereof. The cylindrical sabot includes a plurality of longitudinally extending grooves formed along an internal cylindrical wall thereof. Upon firing of the slug assembly, the slug deformably expands to fill the grooves in the sabot to maintain non-rotative engagement between the slug and the sabot.

As more particularly described by way of preferred embodiments, the sabot shotgun slug assembly includes a cylindrical slug, a cylindrical sabot positioned about the slug and a pressure wad that co-acts with the slug and the sabot. The central slug defines a central bore that extends partially therethrough. The slug is preferably formed of a deformable metal. The sabot defines a plurality of longitudinally extending internal grooves. The pressure wad has two ends, with a gas seal at a first end thereof and a post at a second end thereof. In addition, the pressure wad includes shock-absorbing members formed between the gas seal and the post. The post is positioned within the central bore defined by the slug. In operation, after the sabot shotgun slug assembly is fired, the slug deforms axially and expands outward to fill the plurality of grooves defined in the sabot which mechanically locks the slug and sabot together to stop any slipping movement of the slug when torque is transferred to the slug through the sabot due to the twist of the rifling. The slug simultaneously expands inward to engage the post such that the slug, the sabot and the pressure wad remain connected together while travelling downrange toward a target.

The sabot and the gas seal preferably have substantially the same outer diameter. The pressure wad may further include an intermediate disk formed integrally with the shot absorbing members. The intermediate disk and the gas seal may have substantially the same outer diameter as the sabot. The shock absorbing members are preferably formed as chevrons extending between the gas seal and the post.

In an alternative embodiment, the sabot shotgun slug assembly includes a cylindrical slug, a cylindrical sabot positioned about the slug, a pressure wad and a separate insert support member. The cylindrical slug defines a central bore extending partially therethrough. The slug is preferably formed of a deformable metal. The sabot defines a plurality of longitudinally extending internal grooves. The pressure wad has a gas seal and a plurality of shock absorbing members. The insert support member includes a post portion and a disk portion. The post portion is positioned within the central bore defined by the slug. In operation, after the sabot shotgun slug assembly is fired, the slug deforms axially and expands outward to fill the plurality of grooves defined in the sabot. This action mechanically locks the slug and sabot together to stop any slipping movement of the slug when torque is transferred to the slug through the sabot due to the twist of the rifling. Simultaneously the slug expands inward to engage the post portion such that the slug, the sabot, the insert support member remain connected together while travelling downrange toward a target. The pressure wad falls away when exiting the barrel.

A complete understanding of the present invention will become apparent from the following detailed description, in conjunction with the drawings, wherein like parts are designated with primed reference numerals.

DETAILED DESCRIPTION OF TILE PREFERRED EMBODIMENTS

The present invention describes a projectile intended for use as part of a firearm round (not shown). In particular, the present invention provides a sabot shotgun slug assembly that can be fired from any caliber shotgun that has a rifled barrel, a rifled choke tube or a smoothbore barrel with a true cylinder or an improved cylinder choke. The sabot shotgun slug assembly is intended to remain as a one-piece unit while travelling downrange toward a target after firing.

Referring now to FIGS. 1–5, the sabot shotgun slug assembly 10 is a three-piece member and generally includes a cylindrical slug 12, a cylindrical sabot 14 positioned about the slug 12 and a pressure wad 16.

Figures 1, 2, 3, 4, 5, 6, 7:
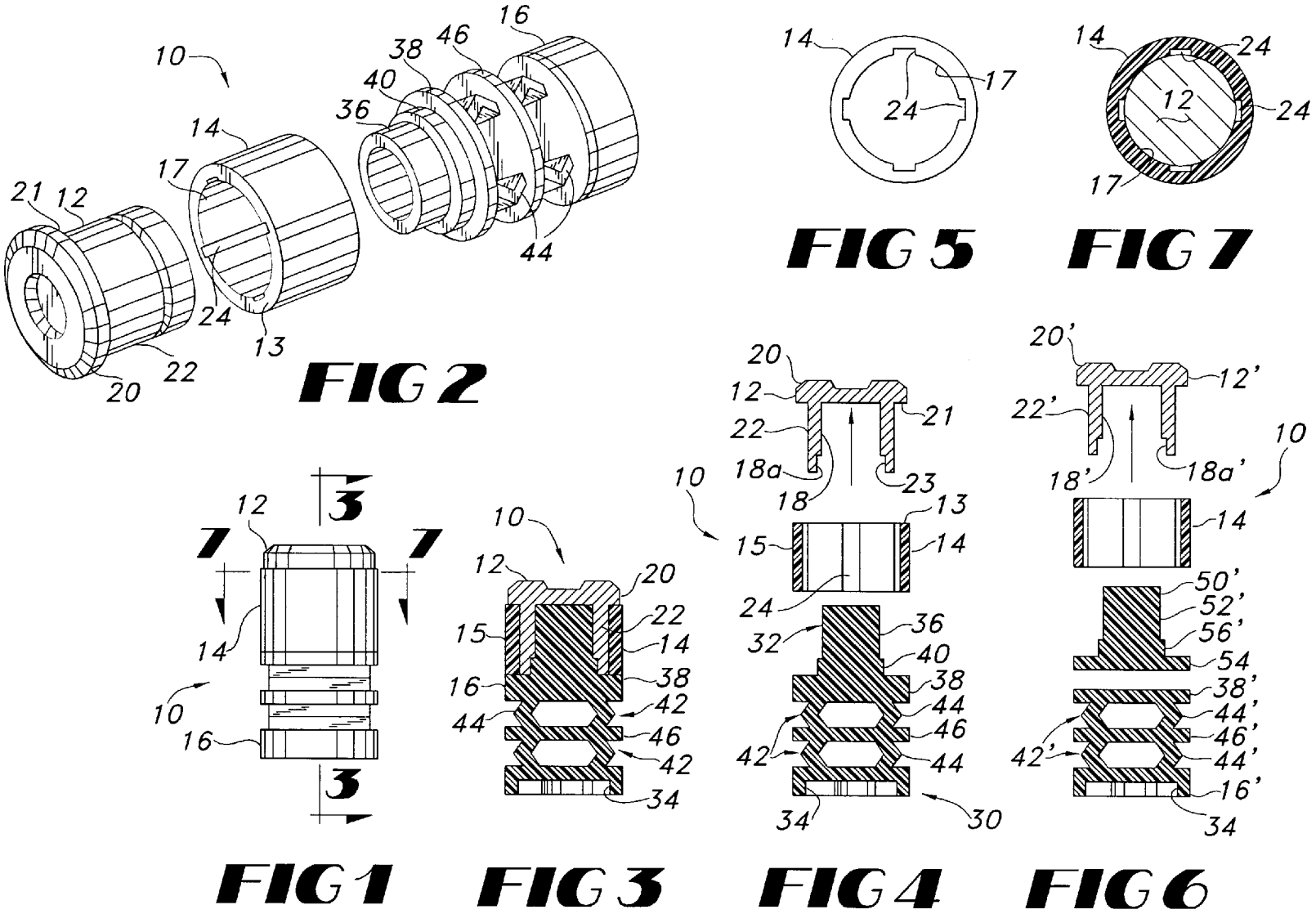
FIG. 1 is an elevation view of a sabot shotgun slug assembly made in accordance with the present invention.
FIG. 2 is an exploded perspective view of the sabot shotgun slug assembly shown in FIG. 1.
FIG. 3 is a cross-sectional view along line III—III in FIG. 1.
FIG. 4 is an exploded cross-sectional view of the sabot shotgun slug assembly shown in FIG. 1.
FIG. 5 is an end view of a sabot used in the sabot shotgun slug assembly shown in FIG. 2.
FIG. 6 is an exploded cross-sectional view of an alternative embodiment of the sabot shotgun slug assembly shown in FIG. 1.
FIG. 7 is a cross-sectional view taken along line VII—VII in FIG. 1.

The cylindrical slug 12 defines a central bore 18 that extends partially therethrough. The central bore 18 may also be formed to extend completely through the slug 12. The slug 12 is preferably comprised of a deformable metal such as lead. The slug may also be formed of other deformable materials such as copper, brass, linotype, aluminum, malleable steel and bismuth. As shown in FIGS. 3 and 4, the slug 12 includes a disk-like head 20 and a depending cylindrical body portion 22 that contains the central bore 18 with an open end 18*a*. The central bore 18 is formed as a blind hole in the preferred embodiment and may further include an internal ridge 23, as shown in FIG. 4. The head 20 of slug 12 defines an annular shoulder 21 extending beyond cylindrical body portion 22 so as to seat on sabot 14 as will be described in detail hereinbelow.

The sabot 14 is formed as a cylindrical sleeve configured to be positioned about the slug 12. In particular, the sabot 14 is configured to be positioned about the cylindrical portion 22 of the slug 12. Sabot 14 includes an upper annular rim 13 which is designed to seat shoulder 21 of slug 12. The disk like head 20 has a diameter which is substantially equal to the outer diameter of sabot 14. The sabot 14 includes an elongate cylindrical body 15 having an internal cylindrical wall 17. A plurality of longitudinally extending internal grooves 24 are formed in internal wall 17. The grooves 24 are spaced symmetrically around the internal circumference of the sabot 14. FIGS. 2 and 5 each show four internal grooves 24 in the sabot 14. As will be appreciated by those skilled in the art, additional or fewer grooves 24 may be provided within the sabot 14. The present invention envisions that a minimum of four of the grooves 24 will be formed within the sabot 14.

The sabot 14 is preferably formed of plastic such as nylon or Zytel 801 ST. As will be appreciated by those skilled in the art, the outer diameter of the sabot will be the same diameter as the groove diameter of the rifle barrel in which it is to be fired, so that the sabot 14 may impart rotational movement to the sabot shotgun slug 10. For a smoothbore barrel, the sabot 14 has an outer diameter that is approximately equal to the inside diameter of the barrel.

The sabot shotgun slug assembly 10 made in accordance with the present invention further includes the pressure wad 16. The pressure wad 16 has a first end 30 and a second end 32. A gas seal 34 is formed at the first end 30 and an extending support post 36 is formed at the second end 32 of the pressure wad 16. As will be appreciated by those skilled in the art, the gas seal 34 operates to trap gas escaping from the compression of a powder charge (not shown) used to propel the sabot shotgun slug assembly 10 during firing. The post 36 is formed to fit snugly, but removable, within the central bore 18 of the slug 12 in an unfired state. Thus, as assembled, the cylindrical portion 22 of slug 12 resides within the inner cylindrical wall 17 of the sabot 14 before seating the post 36. The pressure wad 16 includes an initial disk 38 having a shoulder 40 formed immediately adjacent the post 36. The initial disk 38 preferably has a diameter substantially equal to the diameter of the sabot 14.

A plurality of shock absorbing members 42 are formed between the gas seal 34 and the initial disk 38. The shock absorbing members 42 are preferably formed as chevrons 44 that extend between the gas seal 34 and the initial disk 38. As will be appreciated by those skilled in the art, the chevrons 44 absorb the shock produced during compression of the powder charge used to propel the sabot shotgun slug 10 during firing.

An intermediate disk 46 is formed integrally with the shock absorbing members 42. The intermediate disk 46 and the gas seal 34 preferably have substantially the same outer diameter as the sabot 14. The intermediate disk 46 operates as a secondary barrier to trap propelling gases that result from the compression of the powder charge upon firing the sabot shotgun slug 10. The pressure wad 16 is preferably formed as a unitary piece and of plastic material such as polyethylene.

Referring now to FIG. 6, an alternative embodiment of the sabot shotgun slug assembly is shown and designated with reference numeral 10'. Sabot shotgun slug assembly 10' shown in FIG. 6 is substantially identical to the sabot shotgun slug assembly 10 discussed hereinabove, but a pressure wad 16' no longer includes an integrally formed post 36. The pressure wad 16' in the embodiment shown in FIG. 6 includes a gas seal 34', shock absorbing members 42', an intermediate disk 46' and an initial disk 38'. The sabot shotgun slug assembly 10' in this embodiment further includes a separated formed insert support member 50' having a post portion 52' and a support disk portion 54' having an integrally formed shoulder member 56. The post portion 52' is formed similar to the post 36 of the pressure wad 16 discussed hereinabove and is configured to fit within central bore 18' defined by slug 12'. The support disk portion 54' and the shoulder member 56' are formed similar to the initial disk 38 and the shoulder 40 discussed previously. The post portion 52' is formed integrally with the support disk portion 54', and is not connected to the pressure wad 16'. The outer diameter of the support disk portion 54' preferably has the same outer diameter as sabot 14. The pressure wad 16' is not connected to the insert support member 50'.

Referring now to FIGS. 7–13, operation of the sabot shotgun slug assembly 10 made in accordance with the present invention will now be discussed.

FIG. 7 is a cross-sectional view along line VII—VII in FIG. 1 and shows the sabot shotgun slug assembly 10 in an unfired state. In the unfired state, the internal longitudinal grooves 24 defined in the sabot 14 are voids. The cylindrical portion 22 of the slug 12 is in contact along its outer circumference with the inner cylindrical wall 17 of the sabot 14, except in the vicinity of the internal longitudinal grooves 24.

Figure 8:
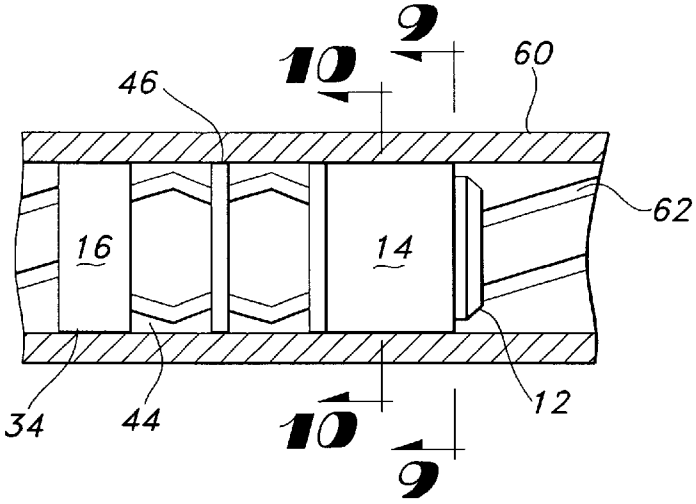
FIG. 8 is an elevation view of the sabot shotgun slug assembly of FIG. 1 immediately after firing and showing a shotgun barrel in partial cross section.

FIG. 8 shows the sabot shotgun slug assembly 10 after firing and travelling in a gun barrel 60. The sabot shotgun slug assembly 10 is typically housed within a shell casing (not shown), which will also typically include a powder charge (not shown) used to propel the sabot shotgun slug assembly 10, as will be appreciated by those skilled in the art. The gas seal 34 of the pressure wad 16 will seal off the powder charge and will trap gas escaping after compression of the powder charge during firing. The positioning of the sabot shotgun slug assembly 10 within a shell casing is well known and conventional in the art and is not necessary for an understanding of the present invention. When the sabot shotgun slug assembly 10 is fired, pressure is exerted on the gas seal 34 of the pressure wad 16. The pressure exerted on the gas seal 34 causes the sabot shotgun slug assembly 10 to travel down the gun barrel 60. The pressure exerted on the gas seal 34 is then transferred to the slug 12, which is coupled to the pressure wad 16.

Figure 9:
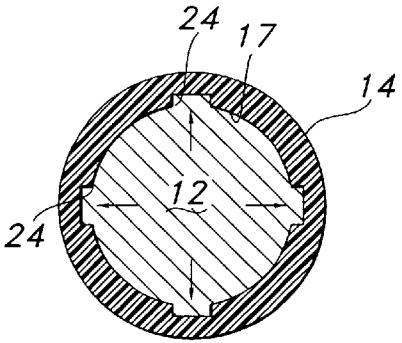
FIG. 9 is a cross-sectional view of the sabot shotgun slug assembly of FIG. 8 taken along line IX—IX.

The slug 12 being made of a deformable material will compress and expand under this pressure. In particular, when the slug 12 comes under pressure, the cylindrical portion 22 of the slug 12 will deform axially such that the cylindrical portion 22 expands outward into mechanical engagement with the sabot 14, as is shown in FIG. 9. In particular, the slug 12 expands outward to fill the internal grooves 24 defined in the sabot 14. The expansion of the slug 12 into the internal grooves of the sabot 14 mechanically locks the slug 12 and sabot 14 together which stops the slipping or movement of the slug 12 inside the sabot 14 when torque is transferred to the sabot 14 due to the twist of the rifling in the barrel. The outward expansion of the slug 12 against the sabot 14 also forces the sabot 14 evenly outward along its entire length into the rifling 62 formed within the gun barrel 60. In a smoothbore gun barrel (not shown), the sabot 14 will form a tight seal with the internal surface of the gun barrel.

Figure 10:
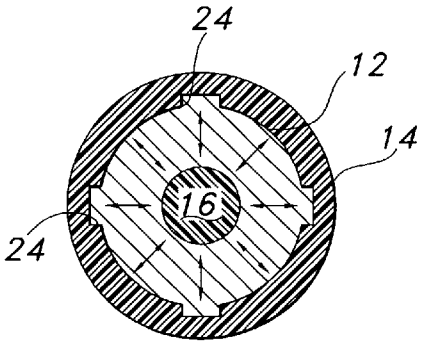
FIG. 10 is a cross-sectional view of the sabot shotgun slug assembly of FIG. 8 taken along line X—X.
Figure 11:
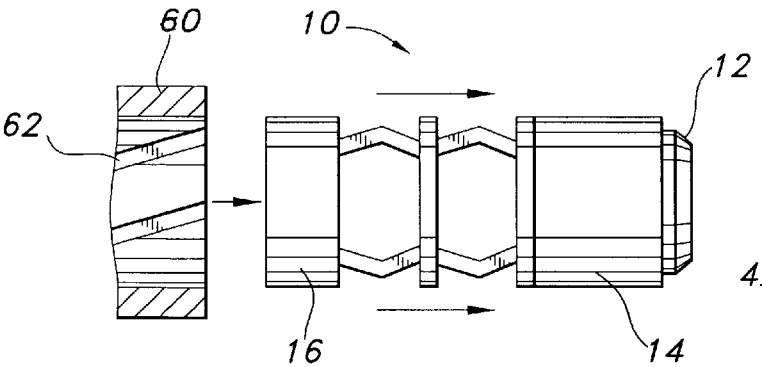
FIG. 11 is an elevation view of the sabot shotgun slug assembly showing the sabot shotgun slug exiting the shotgun barrel shown in FIG. 8.

Referring now to FIG. 10, at the same time the cylindrical portion 22 of the slug 12 deforms and expands outwardly, it will also expand inwardly to engage the post 36 of the pressure wad 16. In particular, the thin wall of the cylindrical portion 22 deforms axially and expands inward thereby locking itself onto the post 36 of the pressure wad 16, or the post portion 52 of the insert support member 50 shown in FIG. 6. In this manner, the slug 12, the sabot 14 and the pressure wad 16 are mechanically locked together and remain locked together as the sabot shotgun slug 10 exits the gun barrel 60, as shown in FIG. 11. The slug 12, the sabot 14 and the pressure wad 16 remain connected together while travelling downrange toward a target.

Figure 13:
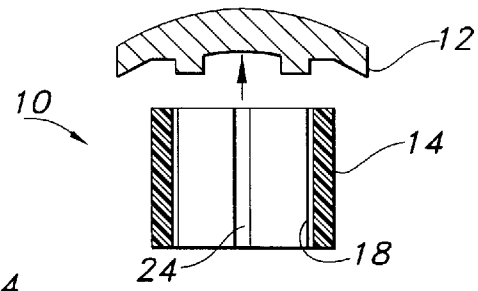
FIG. 13 is a cross-sectional view of the sabot shotgun slug showing the sabot shotgun slug assembly immediately after impact with a target.
Figure 13:
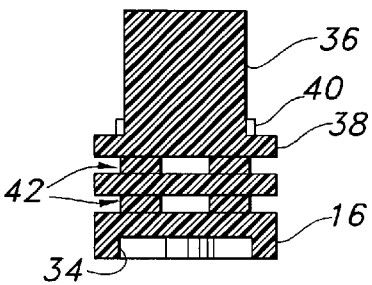
Figure 12:
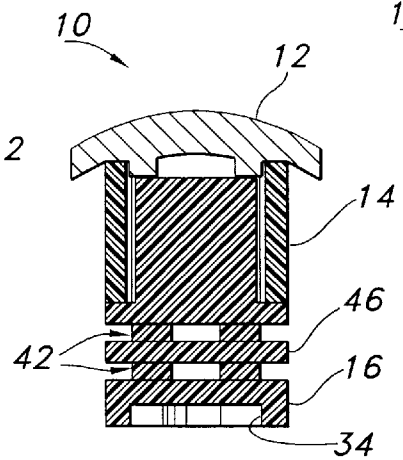
FIG. 12 is a cross-sectional view of the sabot shotgun slug assembly at the moment of impact with a target.

FIGS. 12 and 13 respectively show the sabot shotgun slug assembly 10 immediately upon impact (FIG. 12) and immediately after impact (FIG. 13) with a target.

In FIG. 12, upon impact, the slug 12 will compress axially and the cylindrical portion 22 of the slug 12 will continue forward and slide up the post 36 of the pressure wad 16, or the insert support member 50 shown in FIG. 6. Immediately after impact with a target, as shown in FIG. 13, the now compressed slug 12 will continue its forward motion into the target while the sabot 14 and the pressure wad 16 or the insert support member are discarded. The sabot 14 cannot continue any forward movement due to the fact that it is trapped under the head 20 of the slug 12.

The advantage of the sabot shotgun slug assembly 10 of the present invention is that it maintains the slug 12 symmetrical when under pressure in a gun barrel. The central axis of the slug 12 will remain in line with the central axis of the gun barrel; also the sabot expands evenly down its length to fully engage the rifling or the bore of a smooth bore. The slug is mechanically locked to the sabot, which stops the slug slipping or moving inside the sabot when fired, thus making the sabot shotgun slug 10 of the present invention more accurate.

While the preferred embodiments of the present invention have been described above, various modifications and variations of the present invention may be made without departing from the spirit and scope of the present invention. The scope of the present invention is defined in the appended claims and equivalents thereto.

What is claimed is:

1. A sabot shotgun slug assembly comprising:

a one-piece hollow cylindrical sabot;

a pressure wad supported at one end of said sabot for facilitating firing;

a deformably expandable slug insertably accommodated in said cylindrical sabot at the other end thereof, said cylindrical sabot including a plurality of longitudinally extending spaced apart grooves formed along an internal cylindrical wall thereof;

whereby upon said firing, said slug deformably expands to fill said grooves to maintain non-rotative engagement between said slug and said sabot.

2. A sabot assembly of claim 1 wherein said pressure wad is attachably coupled to said sabot.

3. A sabot assembly of claim 2 wherein said pressure wad is attachably coupled by said slug.

4. A sabot assembly of claim 3 wherein said pressure wad includes a cylindrical post extending into said cylindrical sabot so as to define an annular region between said post and said interior wall of said sabot for accommodating said slug therein.

5. A sabot assembly of claim 4 wherein said slug includes a transverse head and a depending cylindrical body defining a central bore, said post being insertable into said cylindrical bore of said slug so as to capture said slug within said annular region.

6. A sabot assembly of claim 5 wherein said pressure wad further includes a first end defining a gas seal, an opposite second end having said post extending therefrom and at least one shock absorbing member therebetween.

7. A sabot assembly of claim 6 wherein said pressure wad is integrally formed.

8. A sabot assembly of claim 6 wherein said second end of said pressure wad is formed separately from said shock absorber member and said first end.

9. A sabot assembly of claim 6 wherein said gas seal is disk-like in shape having a diameter substantially equal to the outer diameter of said cylindrical sabot.

10. A sabot assembly of claim 9 wherein said head of said slug is disk-like in shape having a diameter substantially equal to said cylindrical sabot.

11. A sabot assembly of claim 6 wherein said shock absorbing member includes a deformable chevron.

12. A sabot assembly of claim 11 further including a pair of longitudinally spaced deformable chevrons.

13. A sabot assembly of claim 12 wherein said pressure wad further includes an intermediate disk-like gas seal between said chevrons, said intermediate seal having a diameter substantially equal to said cylindrical sabot.

14. A projectile which is fired from a shotgun bore comprising:

a cylindrical sabot having an outer diameter for accommodation within said shotgun bore;

a slug supported within said cylindrical sabot, said slug being deformably expandable upon said firing; and a pressure wad coupled to said sabot by said slug for facilitating said firing;

wherein said cylindrical sabot includes a plurality of longitudinally extending grooves on an inner cylindrical wall thereof, said slug being deformably expandable into said grooves to maintain coupled engagement between said sabot and said slug after said firing.

15. A projectile of claim 14 wherein said slug includes a cylindrical body including an open ended bore therethrough.

16. A projectile of claim 14 wherein said pressure wad includes a post projecting into said bore of said body of said slug for removable frictional securement therein and for supporting said sabot therearound.

17. A projectile of claim 16 wherein said slug is further deformably expandable into locking engagement with said post.

* * * * *